US007108287B2

(12) United States Patent
Vanderheiden et al.

(10) Patent No.: US 7,108,287 B2
(45) Date of Patent: Sep. 19, 2006

(54) METHOD AND PERSONALIZED LABEL AND NOTE PAPER BOOKLET FOR DIRECT MAIL

(75) Inventors: John Vanderheiden, Oneida, WI (US); Bill Hujet, Green Bay, WI (US); Cheryl May, Abrams, WI (US)

(73) Assignee: Moore Wallace North America, Inc., Stamford, CT (US)

( * ) Notice: Subject to any disclaimer, the term of this patent is extended or adjusted under 35 U.S.C. 154(b) by 553 days.

(21) Appl. No.: 10/623,769

(22) Filed: Jul. 22, 2003

(65) Prior Publication Data

US 2004/0135363 A1 Jul. 15, 2004

(51) Int. Cl.
*B42D 15/00* (2006.01)

(52) U.S. Cl. ..... 283/81; 283/56; 283/63.1; 283/51; 283/116

(58) Field of Classification Search ..... 283/81, 283/51, 52, 52.1, 63.1, 116, 56, 67
See application file for complete search history.

(56) References Cited

U.S. PATENT DOCUMENTS

| | | | | |
|---|---|---|---|---|
| 1,350,733 | A | 8/1920 | Olson | |
| 1,370,871 | A | 3/1921 | Allison | |
| 1,585,946 | A | 5/1926 | Swenson | |
| 2,215,163 | A | 9/1940 | Shedd | |
| 3,520,560 | A | 7/1970 | Isaac | |
| 3,718,277 | A | 2/1973 | Volkert | |
| 3,899,381 | A | 8/1975 | O'Brien | |
| 4,685,699 | A | 8/1987 | Hirasawa | |
| 4,756,468 | A * | 7/1988 | Jenkins | 229/304 |
| 4,781,322 | A | 11/1988 | Humm | |
| 4,809,905 | A | 3/1989 | Goodman | |
| 5,104,146 | A | 4/1992 | Schulz | |
| 5,192,093 | A | 3/1993 | Zeisky | |
| 5,333,909 | A | 8/1994 | Hedge | |
| 5,344,190 | A | 9/1994 | Volz | |
| 5,423,573 | A | 6/1995 | De Passille | |
| 5,487,566 | A | 1/1996 | Hedge, Jr. | |
| 5,653,473 | A * | 8/1997 | Laszutko et al. | 283/81 |
| 5,727,817 | A | 3/1998 | Kraige | |
| 5,803,499 | A | 9/1998 | Tung et al. | |
| 6,062,603 | A | 5/2000 | Rich | |
| 6,089,613 | A * | 7/2000 | Petkovsek | 283/79 |
| 6,276,723 | B1 | 8/2001 | Willard | |
| 6,276,724 | B1 | 8/2001 | Zorn | |
| 6,533,324 | B1 * | 3/2003 | Zorn | 283/56 |
| 6,755,442 | B1 * | 6/2004 | Franko et al. | 283/94 |
| 2001/0009331 | A1 | 7/2001 | Zorn | |
| 2001/0011820 | A1 | 8/2001 | Olivar | |
| 2002/0046089 | A1 | 4/2002 | Zorn | |

FOREIGN PATENT DOCUMENTS

| | | |
|---|---|---|
| GB | 2 194 198 | 3/1988 |

* cited by examiner

*Primary Examiner*—Willmon Fridie, Jr.
(74) *Attorney, Agent, or Firm*—Hanley, Flight & Zimmerman, LLC.

(57) ABSTRACT

A high speed method for producing a booklet containing a personalized mail reply form, a set of personalized return address mail stickers, event and endorsement stickers, and a collated tablet of personalized note paper, such as stationary. The entire booklet can be inserted into a window envelope or polywrapped, revealing the mailing address for postal delivery. Alternatively, the booklet can be edge tabbed to mail without an envelope.

20 Claims, 5 Drawing Sheets

METHOD AND PERSONALIZED LABEL AND NOTE PAPER BOOKLET FOR DIRECT MAIL

BACKGROUND OF THE INVENTION

It is conventional to include gift premiums in the form of sets of return address or other stickers in direct mail packages, particularly those produced and distributed by fund raising organizations. Sometimes one or two page sets of address stickers are produced for inclusion in the direct mail package. Others produce a small pad of return address stickers that is affixed to a carrier, which is then inserted in a window envelope. A similar competitive format is a set of pressure sensitive adhesive labels on continuous form which carries promotional copy of the back of the liner as well as variable offer information imaged on a large pressure sensitive label on the front of the liner. The form is cut off, folded and inserted in a window envelope.

SUMMARY OF THE INVENTION

The invention is adapted to add value for the mailer and for the recipient by publishing a reply form, labels, and note paper, such as stationary, that may personalized, all in one convenient booklet which is aesthetically superior to the continuous form format mentioned above and which is more efficient for assembly and mailing purposes than the traditional pad of stickers. Providing personalized note paper is an added benefit to the recipient. The personalized note paper may also be used in viral marketing or friend-tell-a-friend campaigns, in which case each note displays a promotional or other relevant communication from the mailer. The recipient can then address the note to friends, associates and neighbors.

In one embodiment, the invention provides a high speed method of producing a booklet addressed to a person or mail recipient and containing a personalized mail reply form, a set of personalized return address mail stickers, event and endorsement stickers, and a collated tablet of personalized note paper. The entire booklet may have up to 20 leaves of paper including the label backers and can be inserted into a window envelope or polywrapped, revealing the mailing address for postal delivery. Alternatively, the booklet can be edge tabbed to mail without an envelope. The finished document contains variably imaged text customized to the recipient and also identifies the party who mailed the booklet.

Thus the invention may be embodied in a high speed method of producing booklets having personalized information therein, comprising: providing a first continuous web, the web defining a first half portion and a second half portion in the width wise direction of the web; printing non variable images and/or text on at least one of said first half portion and said second half portion first face; providing variable information on at least a first face of said first half portion of said first web, said variable information including outgoing address indicia; providing at least one second, label web, each second web defining a first half portion and a second half portion in the width wise direction; printing at least one of images and text on at least a first face of said first half portion of said second web; applying glue to the second face of the first half portion of said second web; adhering a release liner to cover and protect said glue on said second web second face; cutting said first half portion of said second web to define labels or stickers supported on said release liner; providing at least one third web, each third web defining a first half portion and a second half portion in the width wise direction; printing at least one of images and text on the first face of the first portion of the at least one third web; stacking the first through third webs; securing the stacked webs at a widthwise middle thereof; folding the stacked webs along the widthwise middle thereof; and cutting the stacked webs in a direction transverse to the feed direction of the webs to produce discrete booklets.

The invention may also be embodied in a personalized label and note paper booklet for direct mail comprising: a first sheet defining a first half portion and a second half portion in the width wise direction, non variable images and/or text being printed on at least one of said first half portion and said second half portion first face, and variable information being provided on at least a first face of said first half portion of said first web, said variable information including outgoing address indicia; at least one second, label sheet, each second web defining a first half portion and a second half portion in the width wise direction, at least one of images and text being printed on at least a first face of said first half portion of said second sheet; glue disposed on the second face of the first half portion of said second sheet; a release liner adhered to cover and protect said glue on said second sheet second face; said first half portion of said second sheet being cut to define discrete labels or stickers supported on said release liner; and at least one third, note paper sheet, each third sheet defining a first half portion and a second half portion in the width wise direction, at least one of images and text being printed on at least a first face of said first half portion of said third sheet; wherein said first through third sheets are stacked, said stacked sheets are secured at or about the widthwise middle thereof, and said stacked sheets are folded along the widthwise middle thereof.

DETAILED DESCRIPTION OF THE INVENTION

Figure 1:
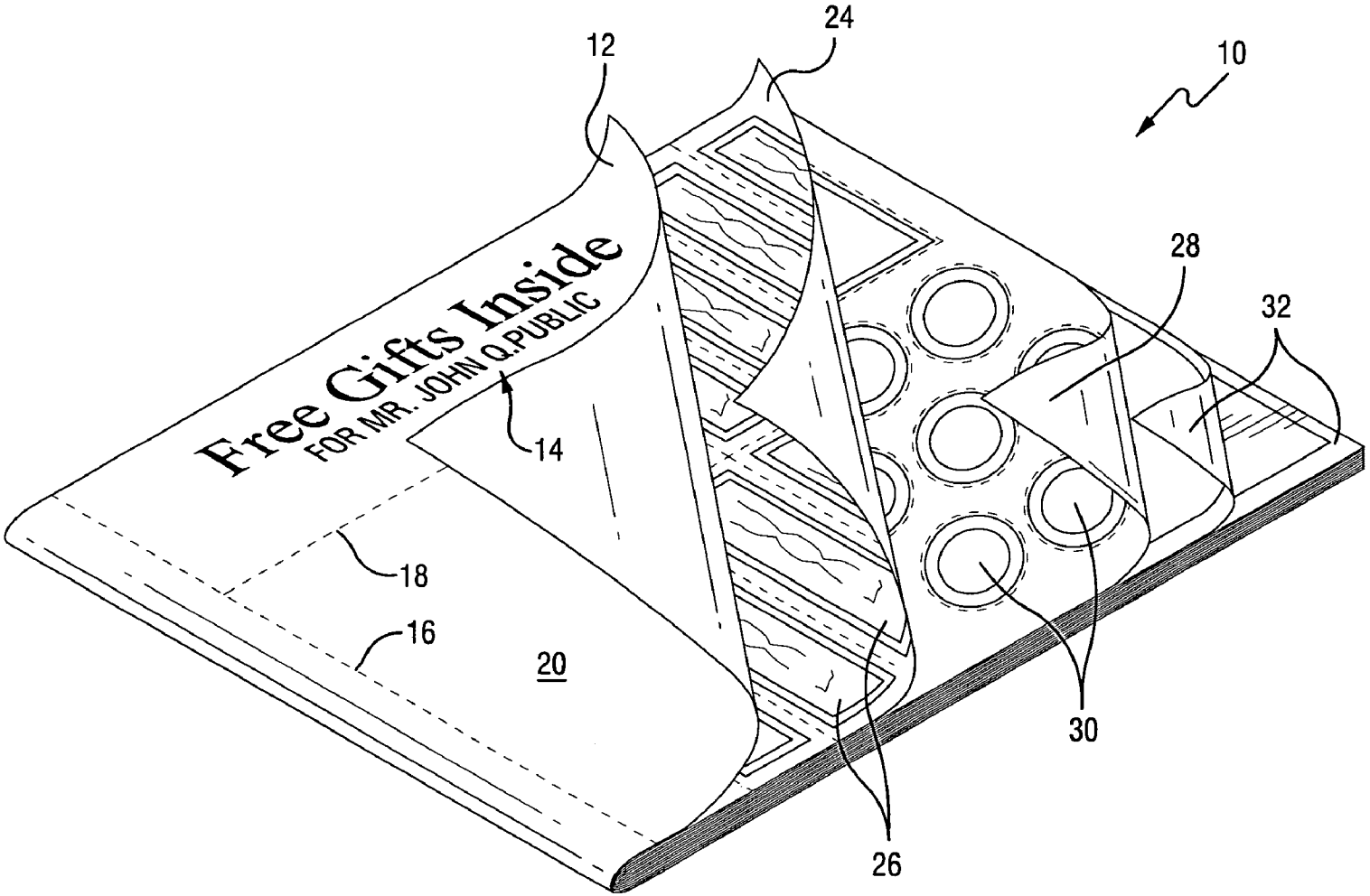
FIG. 1 is a perspective view of an assembled booklet embodying the invention.

A booklet 10 embodying the invention may be formed from a plurality of, e.g., 10 webs of paper stock of varying grades and weights that are merged and adhered, die cut and folded to produce the finished booklet, an example of which is illustrated in FIG. 1. The front cover 12 to the booklet is variably imaged as at 14 to be addressed to a person or mail recipient and may be perforated and/or die cut 16,18 to define a personalized mail reply form 20. Advantageously the personalization of the reply form (FIG. 3) may be used as the outgoing address 22, as described hereinbelow and as suggested in FIG. 5. The finished document can also contain variably imaged text customized to the recipient and/or to identify the party who mailed the booklet.

In an exemplary embodiment, the booklet further includes a page 24 of personalized return address mail stickers 26, a page 28 of event and endorsement stickers 30, and a collated tablet of personalized note paper pages 32. In the illustrated embodiment the sticker pages are provided behind the cover page 12, before the note paper pages 32. It is to be understood, however, that the sticker pages 24,28 may be provided any where in the booklet 10, and do not need to be placed together. In a proposed embodiment, the entire booklet may have up to, e.g., 20 leaves of paper including the label backers. The illustrated embodiment is comprised of 9 webs defining 14 pages, as described more fully herein below. The completed booklet 10 can be inserted e.g., with a reply envelope 34 into a window envelope 36 (FIG. 5) or poly-wrapped, revealing the mailing address for postal delivery. Alternatively, the booklet can be edge tabbed to mail without an envelope.

Figure 2:
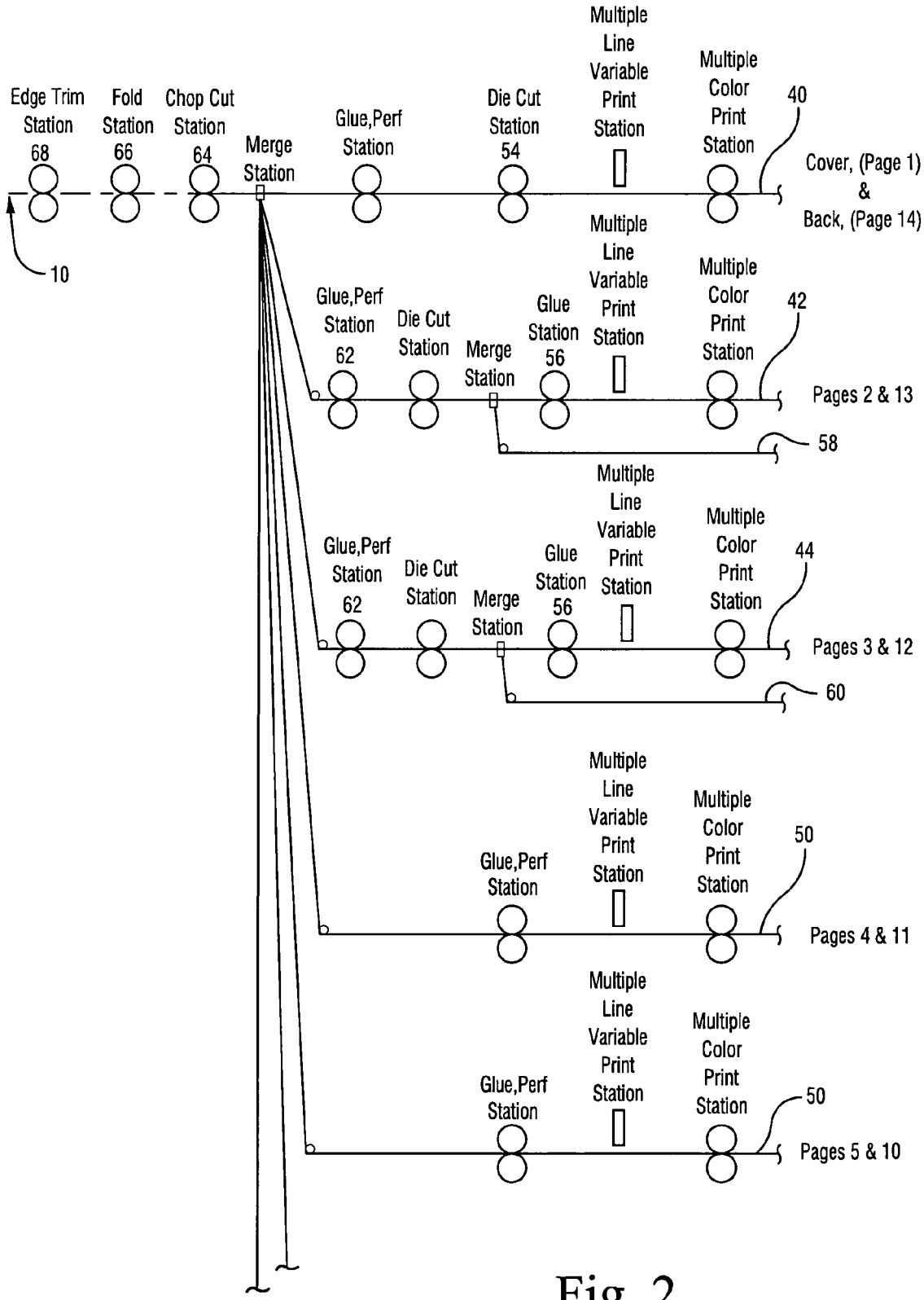
FIG. 2 is a schematic illustration showing the web feed, processing merge and die cutting to produce a booklet embodying the invention.

In an embodiment of the invention, as schematically shown in FIG. 2, plural webs are unwound simultaneously in a multiple printer assembly where they receive ink, variable toner and ink jet imaging, are perforated and/or die cut, and have glue applied as appropriate. The webs are collated, cut and folded into booklets and dispensed onto e.g., a conveyor belt. The books are then shipped to the customer for being inserted, typically with additional correspondence, into mailing envelopes for transmission to the consumer, as mentioned above.

Figure 3:
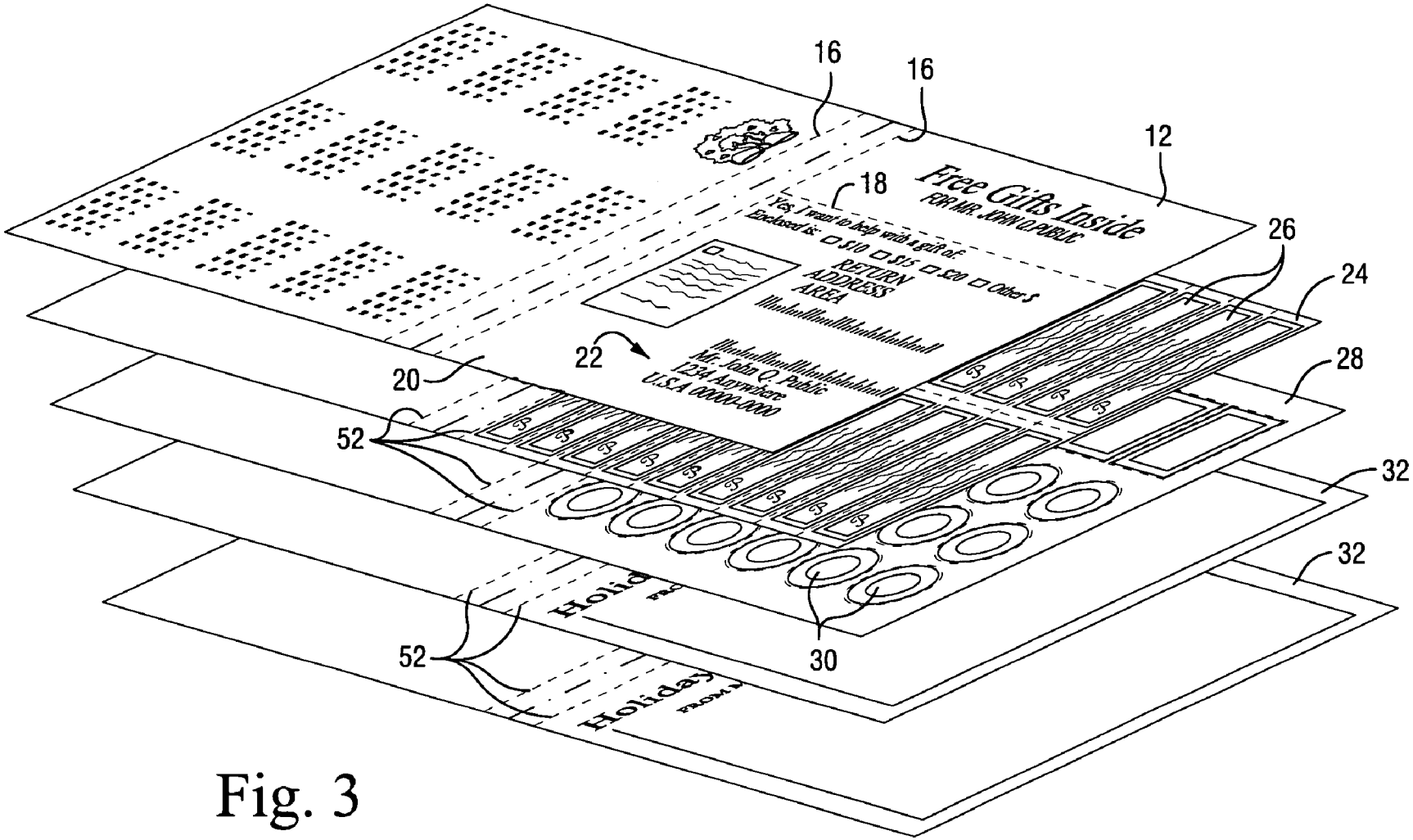
FIG. 3 is an exploded view of the booklet web before folding, taken from above.
Figure 4:
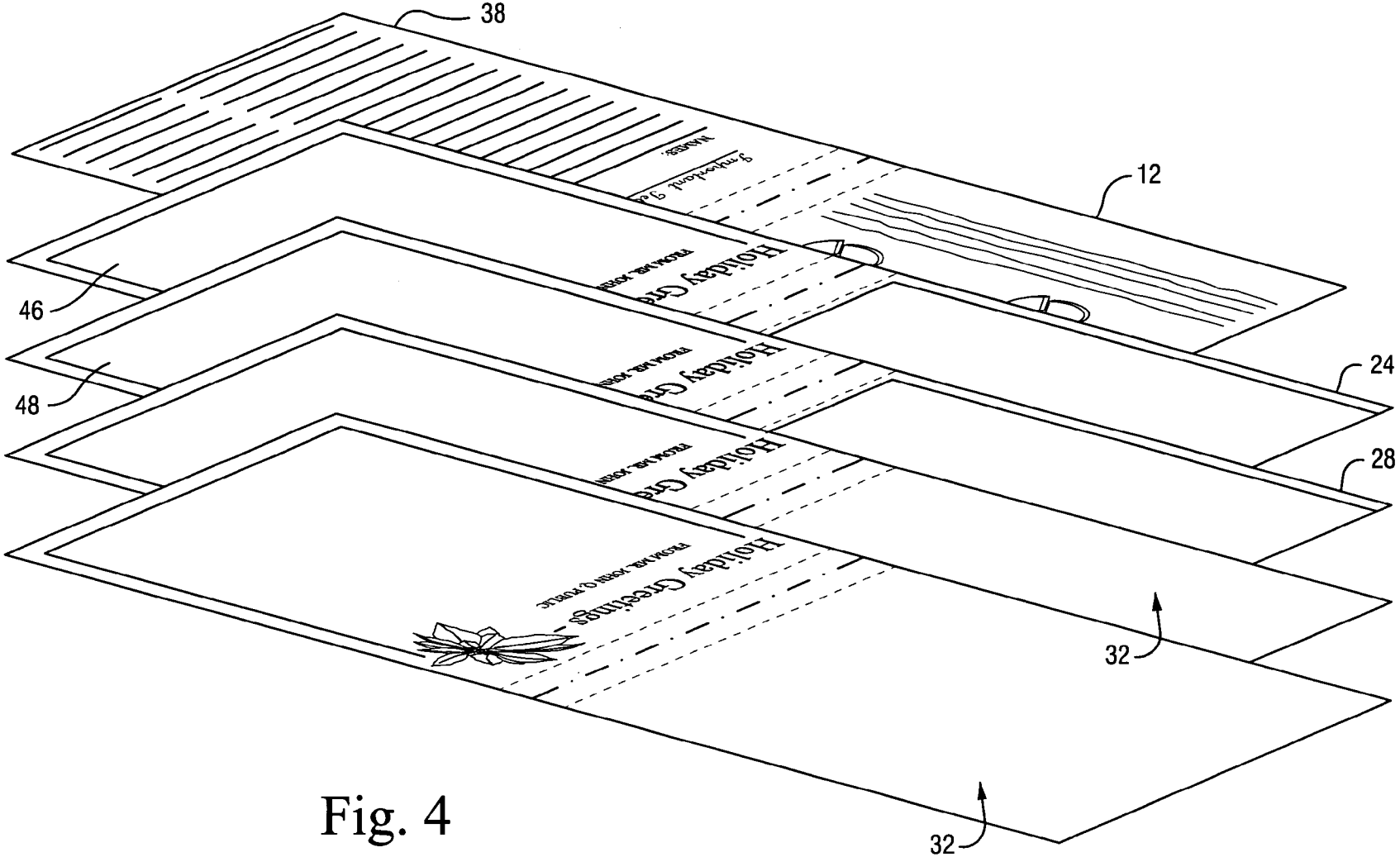
FIG. 4 is an exploded perspective view of the web assembly shown in FIG. 3 but taken from below.

With reference to FIGS. 3 and 4, it should be noted that because the booklet is formed by folding in the width wise direction of the web, approximately half of each web or sheet, in the width direction, will appear in the front half of the booklet and the second half of the web in the width direction will appear in the rear of the booklet. For convenience of explanation, each leaf of the booklet (except for the label backers) will be referred to hereinbelow as a page, so that each web or sheet that is folded to produce the booklet defines 2 pages of the booklet. Moreover, because all of the webs (except for the label backers) will be folded in half to create the booklet with a spine, some of the imaging will be placed on the top faces of the webs and some will be placed on the bottom faces of the webs. As presently proposed, the imaging is placed so that, when the webs are folded, all of the variable imaging will appear on the front faces of the pages of the booklet, including the front cover. However, in the illustrated embodiment, the bottom or back faces defined by the inner surface of the front cover 12 and the back cover of the booklet are also printed.

In an exemplary embodiment, the Moore Multi-printer™ is used for producing the multi-leaf booklet of the invention. The Multi-printer™ is comprised of ten towers situated in line, which house up to six flexographic print decks each. The print cylinders have variable repeat lengths which allow the height of the booklet formed to extend from 4½ inches high up to 15 inches high. In an exemplary embodiment, the booklet formed is approximately 5½ inches high and 7 inches long for being received in an envelope that is approximately 5¾ inches high by 8¼ inches. The towers of the Multi-printer™ also house roll, unwind and turn bars for dispensing webs of paper into the line perforation and die cutting units for creating labels and removable pages, as described in greater detail below; and glue dispensers to bind the booklet pages and activate the label webs. In an embodiment of the invention, as described more particularly hereinbelow, ink is used for flexographic impression, ink jet imaging is supplied using Moore's MICA™ Ink Jet arrays, and toner imaging is supplied using Moore's MIDAX™ toner transfer. To that end, the Multi-printer™ further includes MIDAX™ imaging systems and MICA™ imaging systems to personalize the pages. Folding devices, such as plow devices, and cutoff cylinders and/or chop cutters are further provided to fold the stacked sheets/webs and separate one booklet from the next in the feed direction of the web following collation of the webs. Appropriate gearing (not shown) is provided to synchronize the speed of the many webs being collated and appropriate data systems (not shown in detail) are operatively coupled to the system to apply imaging accurately among the plural webs.

Each web of paper stock is unwound from a respective roll and fed in the direction of the production process. It is pulled under tension through flexographic presses to receive the inks which deliver a graphic design as schematically illustrated in FIGS. 3 and 4. Following delivery of the graphic design, the moving webs are pulled through an imaging device.

As presently proposed, the first web 40 defines the front cover 12 of the booklet and the back cover 39 of the booklet, adjacent one another in a widthwise direction of the web. In the illustrated embodiment, informational text is printed on the inner or back surface of the front cover, and text such as blanks for telephone number listings, is printed on the inner or front surface of the back cover. In the illustrated embodiment, the cover/back web is slit or die cut to reduce its width and/or is provided from a web roll having a width of e.g., ⅝ inch less than the remaining webs so that the cover page 12 is truncated relative to the back page 38 to reveal the label page 24, to intrigue and attract the end user to examine the booklet. Alternatively, the cover and back pages are co-extensive.

In the illustrated embodiment, there is at least one, and more preferably two, second, label or sticker webs 42,44. One half of the first of the second webs in the widthwise direction defines in the illustrated example variably imaged return address labels 26, which correspond to the outgoing address indicia provided on the cover page 12 so as to be customized to the recipient of the mailer. The other half of this web defines personalized note paper for the recipient (as labeled at 46 in FIG. 4). Similarly, one half in the widthwise direction of the second of the second webs defines in the illustrated example event stickers 30. The other half of this web defines personalized note paper 48 for the recipient. In the illustrated assembly, the remaining, third webs 50 each define two pages of personalized note paper 32 for the recipient. Although the sticker pages 24,28 are referred to herein above as formed from second webs 42,44, as mentioned above, the stickers need not be behind the cover and could even be intermingled between the note pages 32 defined by the so called third webs 50. Thus, references to second webs and third webs is for convenience only. It is also to be understood that the pages defined by the second and/or third webs may be truncated (e.g. by slitting, die cutting, or as reduced width web) relative to one another and/or relative to the cover and back pages without departing from this invention.

As suggested above, in an exemplary embodiment the booklet's first, outer cover web and its second, label web pages are pulled through a MIDAX™ imaging systems where they receive toner imaging. As mentioned above, the outer (front) cover receives addressee information 22 for postal delivery as well as other marketing communication directed to the individual recipient. The MIDAX™ system dispenses toner from 8⅓ inch wide rotating cylinder. That cylinder can carry a solid covering of toner along its length if necessary. The cylinder is electrically charged using ion deposition and the charged areas of the cylinder attract black toner from a tray. As the coated cylinder meets the web, it transfers the toner to the web under pressure and the web is momentarily heated to fuse the toner into the grain of the paper. Because of the ample toner coverage available in MIDAX™, there is no obstacle in regards to imaging names and addresses at right angles to the moving direction of the web as with printing the cover to the booklet.

MICA™ Ink Jet Imaging is used when applying names and addresses which run parallel to the direction of the moving web. Accordingly, MICA™ is used in an exemplary embodiment to image the return address labels and the recipient's name for personalization, letterhead style, at the top of each page of note paper.

Downstream of the printing stations, perforations 52 are applied to each of the note paper webs 50 in the booklet. In a presently preferred embodiment, the front and back cover pages and the label pages are also perforated as at 16 and 52 for severance at the spine or binder. These perforations may be applied using a rotary perforation wheel that runs parallel to the direction of the web. In addition or in the alternative, other die cutting and/or perforation creating components may be used, as shown for example at 54, to generate perforated lines about the perimeter of a reply card, coupon, or the like.

As noted above, in the presently proposed embodiment, one of the pages of the booklet is formed with address stickers 26 and one of the pages of the booklet is formed with event and/or decorative stickers 30. These booklet pages 24,28 are formed by feeding, e.g., second, label webs 42,44 for printing and thereafter applying a pressure sensitive glue as at 56 to the back of about one half, in the widthwise direction, of the respective web. The webs are then pressed against respective release coated Silex label backer sheets 58,60. In a preferred embodiment, the Silex label backer material is provided as fourth webs that are truncated in a widthwise direction to cover a little less than one half of the respective second, label web. In this regard, where the booklet is assembled with the aid of stream glue, as described hereinbelow, it is preferred that the label backer not extend to the area defining the spine of the booklet as it would preclude permanent adherence of the webs. Thus, the backer material is provided substantially only at and is adhered only to the label portion of the second webs 42,44. The coated label backer protects the pressure sensitive glue but does not adhere to the glue permanently so that the consumer can remove the labels from the backing as desired. The result is a printed, imaged, laminated, dual web label construction for, e.g., each of the second and third pages 24,28 of the booklet. Concurrently, note paper pages 46,48 are produced by the second halves (in the widthwise direction) of the second webs 42,44.

The laminated label webs are then pulled through a kiss-cutting die, which separates each individual label from its neighbor and/or the remaining web on all sides. The kiss-cut die is accurately named because it will penetrate and cut the label web but is not deep enough to penetrate the label backer web underneath the label.

Following formation of the labels and printing and perforation of the remaining pages of the booklet, the webs are ready to be secured together and folded. In a presently preferred embodiment, the booklet webs are spine glued, chop cut and then folded to define individual booklets. Thus, stream glue is laid down the middle of each web that is to be glued to another. The webs are placed on top of one another, carefully lining up the glue streams in one discrete line on top of each other. As will be appreciated, the order in which the webs are stacked determines the disposition of the respective pages in the booklet. Thus, as noted above, the first, second, and third webs illustrated need not be produced and stacked in that order.

Following stacking, the webs may be folded and then cut into individual booklets, or vice versa. As an example of the former, the stacked webs may be folded by a plow fold device that bends one-half of the moving web over a rotating wheel. The folded over web is then further forced over by a steel arm to meet its other side. The completed fold is then reinforced as the collated, folded webs are pulled between two rollers. The booklet is then complete except for separation from its preceding and following booklets on the production line. In this case, separation may be achieved by a rotating cylinder that houses blades, which cut the booklets to a fixed height of between about 4½ and 15 inches. As noted above, in an exemplary embodiment, the booklets are about 5½ inches in height. As an alternative to separation of the booklets following folding, in the illustrated and presently preferred embodiment, the stacked webs are cut to sheets, e.g. with a chop cutter 64, and then folded at 66 to define the individual booklets.

As a final step in the booklet forming process, the booklets are edge trimmed as at 68 _so that the final booklet 10 has well defined edges, e.g. at the free edge remote from the spine.

As will be appreciated, the webs of paper, which contain precisely measured graphics, text and imaging must be synchronized. This may be achieved by precision gearing that ensures that all cylinders have the exact same circumferences, image repeat length, and periodicy. This is also achieved by exacting web tension to ensure that the web itself does not stretch or flutter. Additionally, each personalized image must be applied at the correct location on each of the webs so that when the webs are collated, they all have the same recipient's name appearing within the booklet and the names appear in the same place on each page. Mismatching may be avoided by using software integrated into the data imaging systems that time frequency to known web length travel between the respective web feed and printing stations or towers. Note in this regard that different webs will feed different distances to the merging station and thus the information printed must be correlated to the time for that web segment to reach the merging station for merger with the correspondingly personalized web sections.

Application of glue also requires careful attention. Pressure sensitive glue must be delivered to the back face of each label sheet, in microscopic thickness of exact consistency across the width of the web. This application requires precision delivery mechanisms which have even access of glue. Stream glue units deliver hot lines of glue to the center of each web. These must be precisely placed as well, in consistent quantity and limited volume. Too wide a glue stream will create a booklet whose pages do not fully open. As an alternative to stream glue, the stacked webs may be secured with mechanical fasteners such as staples, before or after folding, and/or binder clips or the like after folding.

Care must also be taken to properly set the kiss-cut dies to cut the label web without cutting the backer page. Indeed, if the die is too deep the Silex backer will be cut, ruining the page. If the cut is too shallow, the label will not be separated from its neighbor, rendering the label useless to the recipient. Furthermore, because the booklet is to be folded, too heavy a paper will preclude the fold from being accomplished whereas too light a paper may result in ripping of the web during processing.

The booklets provided in accordance with the invention may advantageously have height of up to about 15 inches, contain more than one page of labels and may contain as many as four pages of labels while still providing four pages of personalized note paper or friend-to-friend correspondence pages. Because multiple webs are fed to form the booklet, the booklet pages can be of varying weights and colors, it being understood that each web ultimately forms two booklet leaves and thus defines two pages of the booklet.

Finally, the manufacturing process of the invention is adapted to being performed using web production rather than cut sheet assembly and binding which increases the speed and lowers the cost of the production once the web feed system has been set up for the production. It is to be understood, however, that the booklet produced will comprise stacked first, second, and third (discrete) sheets corresponding to said stacked first through third webs, which are secured and folded (or vice versa) to define the booklet.

Figure 5:
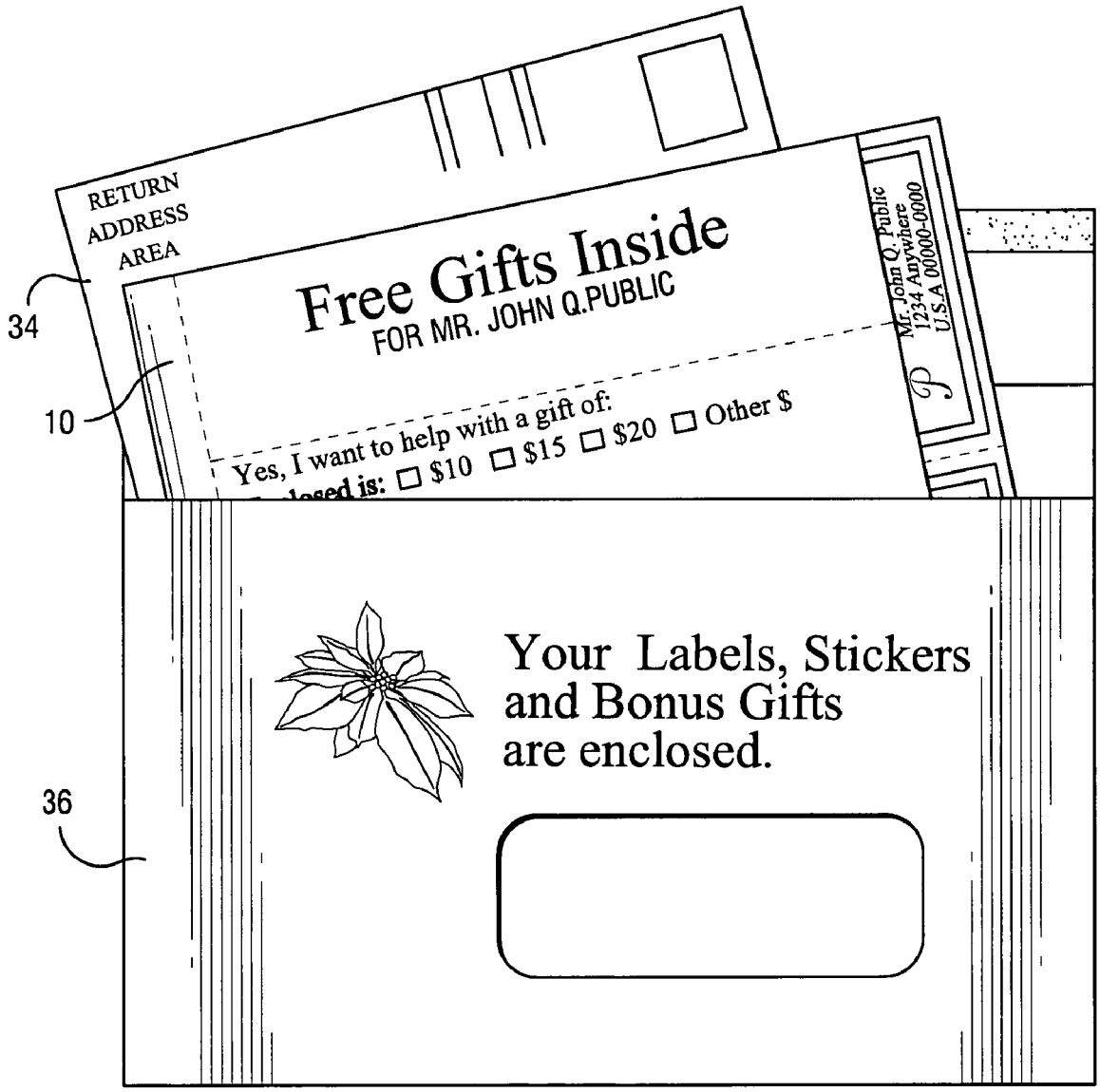
FIG. 5 is a booklet being inserted in a window envelope by the end user.

As mentioned, the booklet is particularly adapted for being inserted in a window envelope by the end user, as shown in FIG. 5. However, because the booklet is self-contained to include address information, tabs may be applied to the side edges of the booklet that are not bound, to seal the booklet for transmission through the mail. In that event, postal indicia such as postage paid indicia is included on the cover of the booklet and the cover page is more preferably not truncated to allow tabbing of the free edges of the booklet, if deemed necessary or desirable.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A high speed method of producing booklets having personalized information therein comprising:

providing a first continuous web, the web defining a first half portion and a second half portion in the width wise direction of the web;

printing non variable images and/or text on at least one of said first half portion and said second half portion first face;

providing variable information on at least a first face of said first half portion of said first web, said variable information including outgoing address indicia;

providing at least one second, label web, each second web defining a first half portion and a second half portion in the width wise direction;

printing at least one of images and text on at least a first face of said first half portion of said second web;

applying glue to the second face of the first half portion of said second web;

adhering a release liner to cover and protect said glue on said second web second face;

cutting said first half portion of said second web to define labels or stickers supported on said release liner;

providing at least one third web, each third web defining a first half portion and a second half portion in the width wise direction;

printing at least one of images and text on the first face of the first portion of the at least one third web;

stacking the first through third webs;

securing the stacked webs at a widthwise middle thereof;

folding the stacked webs along the widthwise middle thereof; and cutting the stacked webs in a direction transverse to the feed direction of the webs to produce discrete booklets.

2. A high speed method as in claim 1, wherein said providing variable information on at least a first face of said first half portion of said first web comprises printing outgoing address indicia directly on said first half portion.

3. A high speed method as in claim 1, wherein said securing comprises applying a glue stream to the widthwise middle of at least one face of at least one of the second and third webs before said stacking.

4. A high speed method as in claim 1, wherein said securing precedes said folding.

5. A high speed method as in claim 1, wherein said cutting precedes said folding.

6. A high speed method as in claim 1, further comprising forming at least one perforated line extending in the web feed direction adjacent and parallel to the width wise middle of the third web.

7. A high speed method as in claim 1, wherein said cutting comprises kiss-cutting the first portion of the at least one second web to define discrete, generally rectangular label portion.

8. A high speed method as in claim 1, wherein the release liner is provided as a continuous web.

9. A high speed method as in claim 1, wherein there are at least two second webs for forming labels, at least one of said second webs being printed with variably imaged address indicia corresponding to said outgoing address.

10. A high speed method as in claim 1, wherein there are a plurality of third webs.

11. A high speed method as in claim 1, comprising variably printing each third web on the first face of the first portion and on the second face of the second portion.

12. A high speed method as in claim 11, wherein said variable printing on each third web corresponds to at least a portion of said outgoing address indicia.

13. A high speed method as in claim 1, further comprising die cutting the cover page to define a removable reply slip.

14. A personalized label and note paper booklet for direct mail comprising:

a first sheet defining a first half portion and a second half portion in the width wise direction, non variable images and/or text being printed on at least one of said first half portion and said second half portion first face, and variable information being provided on at least a first face of said first half portion of said first web, said variable information including outgoing address indicia;

at least one second, label sheet, each second web defining a first half portion and a second half portion in the width wise direction, at least one of images and text being printed on at least a first face of said first half portion of said second sheet;

glue disposed on the second face of the first half portion of said second sheet;

a release liner adhered to cover and protect said glue on said second sheet second face;

said first half portion of said second sheet being cut to define discrete labels or stickers supported on said release liner; and at least one third, note paper sheet, each third sheet defining a first half portion and a second half portion in the width wise direction, at least one of images and text being printed on at least a first face of said first half portion of said third sheet;

wherein said first through third sheets are stacked, said stacked sheets are secured at or about the widthwise middle thereof, and said stacked sheets are folded along the widthwise middle thereof.

15. A booklet as in claim 14, wherein the stacked sheets are secured with glue.

16. A booklet as in claim 14, wherein there is at least one perforated line defined adjacent and parallel to the width wise middle of the third sheet.

17. A booklet as in claim 14, wherein there are at least two second, label sheets, at least one of said second sheets being printed with variably imaged address indicia corresponding to said outgoing address indicia.

18. A booklet as in claim 14, wherein there are a plurality of third, note paper sheets.

19. A booklet as in claim 14, wherein each third sheet is variably printed on the first face of the first half portion and on the second face of the second half portion, said variable printing on each third web corresponding to at least a portion of said outgoing address indicia.

20. A booklet as in claim 14, wherein the first half portion of the first sheet is die cut to define a removable reply slip.

* * * * *